US010889390B2

(12) United States Patent
Biondi et al.

(10) Patent No.: US 10,889,390 B2
(45) **Date of Patent: *Jan. 12, 2021**

(54) AUTOMATIC PACKAGING MACHINE FOR FILLING A BAG MADE OF A HEAT-SEALABLE MATERIAL WITH A DOSE OF A LOOSE PRODUCT

(71) Applicant: Volpak, S.A.U., Santa Perpetua de Mogoda (ES)

(72) Inventors: Andrea Biondi, Bologna (IT); Umberto Zanetti, Modena (IT); Sauro Uccellari, Bologna (IT); Silvio Quaglia, Milan (IT)

(73) Assignee: VOLPAK. S.A.U., Santa Perpetua De Mogoda (ES)

( * ) Notice: Subject to any disclaimer, the term of this patent is extended or adjusted under 35 U.S.C. 154(b) by 179 days.

This patent is subject to a terminal disclaimer.

(21) Appl. No.: 15/964,392

(22) Filed: Apr. 27, 2018

(65) Prior Publication Data

US 2018/0312280 A1 Nov. 1, 2018

(30) Foreign Application Priority Data

Apr. 28, 2017 (EP) ..... 17168643

(51) Int. Cl.
*B65B 1/10* (2006.01)
*B65B 37/08* (2006.01)
(Continued)

(52) U.S. Cl.
CPC ..... *B65B 1/10* (2013.01); *B65B 37/08* (2013.01); *B65B 43/123* (2013.01); *B65B 43/28* (2013.01);
(Continued)

(58) Field of Classification Search
CPC .... B65B 1/10; B65B 1/02; B65B 1/06; B65B 37/08; B65B 37/02; B65B 43/123;
(Continued)

(56) References Cited

U.S. PATENT DOCUMENTS 3,323,280 A * 6/1967 Rausch ..... B65B 43/26 53/571
6,119,440 A * 9/2000 Benner, Jr. ..... B65B 39/145 53/202

(Continued)

FOREIGN PATENT DOCUMENTS

| | | |
|---|---|---|
| DE | 3416567 A1 | 12/1985 |
| EP | 2572996 A1 | 3/2013 |
| WO | 2005/058704 | 6/2005 |

OTHER PUBLICATIONS

Partial European Search report of EP 17 16 8643 Filed Nov. 10, 2017.

(Continued)

*Primary Examiner* — Thomas M Wittenschlaeger
(74) *Attorney, Agent, or Firm* — Sughrue Mion, PLLC

(57) ABSTRACT

Automatic packaging machine (3) for filling a bag (1) made of heat-sealable material, having an open upper end (2) with a dose of loose product; the packaging machine (3) has: a packaging conveyor (4); a pick-up head (7), which is supported by the packaging conveyor (4) to advance along a packaging path (P1); an input station (S1) where the empty bag (1) is grabbed by the pick-up head (7); an output station (S2) where the full, sealed bag (1) leaves the pick-up head (7); a filling device (18) that is mounted on the packaging conveyor (4) to move together with the pick-up head (7) along the entire packaging path (P1) and is adapted to supply the dose of product inside the bag (1) through the upper open end (2); and a sealing device (19) that is mounted on the packaging conveyor (4) to move together with the pick-up
(Continued)

head (7) along the entire packaging path (P1) and is adapted to seal the full bag (1) through a heat-seal at the open upper end (2).

23 Claims, 14 Drawing Sheets

(51) Int. Cl.

| | |
|---|---|
| ***B65B 43/12*** | (2006.01) |
| ***B65B 43/28*** | (2006.01) |
| ***B65B 43/46*** | (2006.01) |
| ***B65B 43/60*** | (2006.01) |
| ***B65B 51/10*** | (2006.01) |
| ***B65B 57/04*** | (2006.01) |
| ***B65B 65/00*** | (2006.01) |
| ***B65B 57/00*** | (2006.01) |

(52) U.S. Cl.
CPC ..... *B65B 43/465* (2013.01); *B65B 43/60* (2013.01); *B65B 51/10* (2013.01); *B65B 57/00* (2013.01); *B65B 57/04* (2013.01); *B65B 65/003* (2013.01)

(58) Field of Classification Search
CPC ..... B65B 43/28; B65B 43/60; B65B 43/465; B65B 43/06; B65B 43/16; B65B 57/04; B65B 57/00; B65B 65/003; B65B 39/14; B65B 39/145; B65B 51/10
USPC ..... 53/455, 469, 284.7, 562, 570, 250, 252
See application file for complete search history.

(56) References Cited

U.S. PATENT DOCUMENTS

| | | | | |
|---|---|---|---|---|
| 9,567,123 | B2 * | 2/2017 | Mengibar Rivas | B65B 43/50 |
| 2014/0130460 | A1 | 5/2014 | Paunesku et al. | |
| 2015/0027585 | A1 * | 1/2015 | Mengibar Rivas | B65B 43/60 141/94 |
| 2017/0361967 | A1 * | 12/2017 | Campagnoli | B65B 43/465 |
| 2018/0215489 | A1 * | 8/2018 | Gallaun | B65B 39/007 |

OTHER PUBLICATIONS

Partial European Search Report of EP 17 16 8643 filed Mar. 12, 2018.

* cited by examiner

AUTOMATIC PACKAGING MACHINE FOR FILLING A BAG MADE OF A HEAT-SEALABLE MATERIAL WITH A DOSE OF A LOOSE PRODUCT

TECHNICAL FIELD

The present invention relates to an automatic packaging machine for filling a bag made of heat-sealable material with a dose of loose product (i.e. one that does not have any cohesion, any adhesion among the parts that compose it and therefore does not have its own shape, such as a powder product, a grated product or a liquid product).

The present invention is advantageously applied in an automatic packaging machine for filling a bag of heat-sealable material with a dose of a loose food product, to which the following specification will make explicit reference without, for this reason, losing its generality.

PRIOR ART

The patent applications EP2722282A1 and WO2012136869A1 describe an automatic packaging machine for filling a bag made of heat-sealable material with a dose of a loose food product; this packaging machine comprises a packaging conveyor, which supports a plurality of pick-up heads that are adapted to grip and hold a corresponding bag in order to make the pick-up heads advance along a packaging path (the chain that holds the pick-up heads is wrapped around two or three sprockets to give the packaging path a complex form). The packaging path passes through, in succession, an input station in which a preformed bag, empty, open at the upper end and in a flattened configuration (i.e. with the opposite edges of the upper part in close mutual contact) is coupled to a respective pick-up head, an opening station in which each bag is opened by separating the opposite edges of the upper end, a filling station in which a predetermined dose of food product is fed from above into each bag through the open upper end, a sealing station in which the open upper end of each bag is sealed by executing a heat-sealing, and an output station in which each filled and sealed bag leaves the corresponding pick-up head.

Each pick-up head comprises a pair of clamps which are opposite one another and are designed to grab opposite side ends of a corresponding bag; the two clamps of each pick-up head are movable in order to move closer to and away from each other, and so following the deformation of the bag when the same bag is opened (that is, when the opposite edges of the upper end are separated from each other).

In the filling station, through the open upper end of each bag, a filler device is inserted, which feeds, from above, the predetermined dose of food product; the filler device also comprises one or more nozzles, which inject an inert gas into the bag (typically nitrogen) at the same time as the feeding of the food product to reduce the content of oxygen inside the bag.

In the sealing station, there is a sealing clamp, which squeezes the bag at the open upper end in order to apply pressure and heat and determines locally the melting, and thus the sealing, of the plastic material, which constitutes the bag.

The patent application US2014130460A1 describes an automatic packaging machine to fill a bag of sealable material with a dose of loose food product; this packaging machine comprises a drum that supports a variety of gripping heads, each one being designed to grab and hold a corresponding bag to make the same pick-up heads advance along a packaging path. The packaging path passes through, in succession, an input station in which a preformed bag, empty and open at the upper end is coupled to a respective pick-up head, a filling station in which a predetermined dose of food product is fed, from above, into each bag through the open upper end, a sealing device, in which the open upper end of each bag is sealed by executing a heat-sealing, and an output station in which each filled and sealed bag leaves the corresponding pick-up head.

DESCRIPTION OF THE INVENTION

The object of the present invention is to provide an automatic packaging machine for filling a bag made of a heat-sealable material with a dose of a loose product, and so that this automatic packaging machine makes it possible to improve the performance offered by the automatic packaging machines already known with respect to the quality of the product, the percentage of waste (i.e. of defective products), the amount of space used, and the accessibility for the execution of cleaning, maintenance and size change services.

In accordance with the present invention, an automatic packaging machine for filling a bag made of a heat-sealable material with a dose of a loose product is provided, as claimed in the attached claims.

BRIEF DESCRIPTION OF THE DRAWINGS

The present invention will now be described with reference to the annexed drawings, which illustrate an example of a non-limiting embodiment, in which.

PREFERRED MODES FOR CARRYING OUT THE INVENTION

Figure 1:
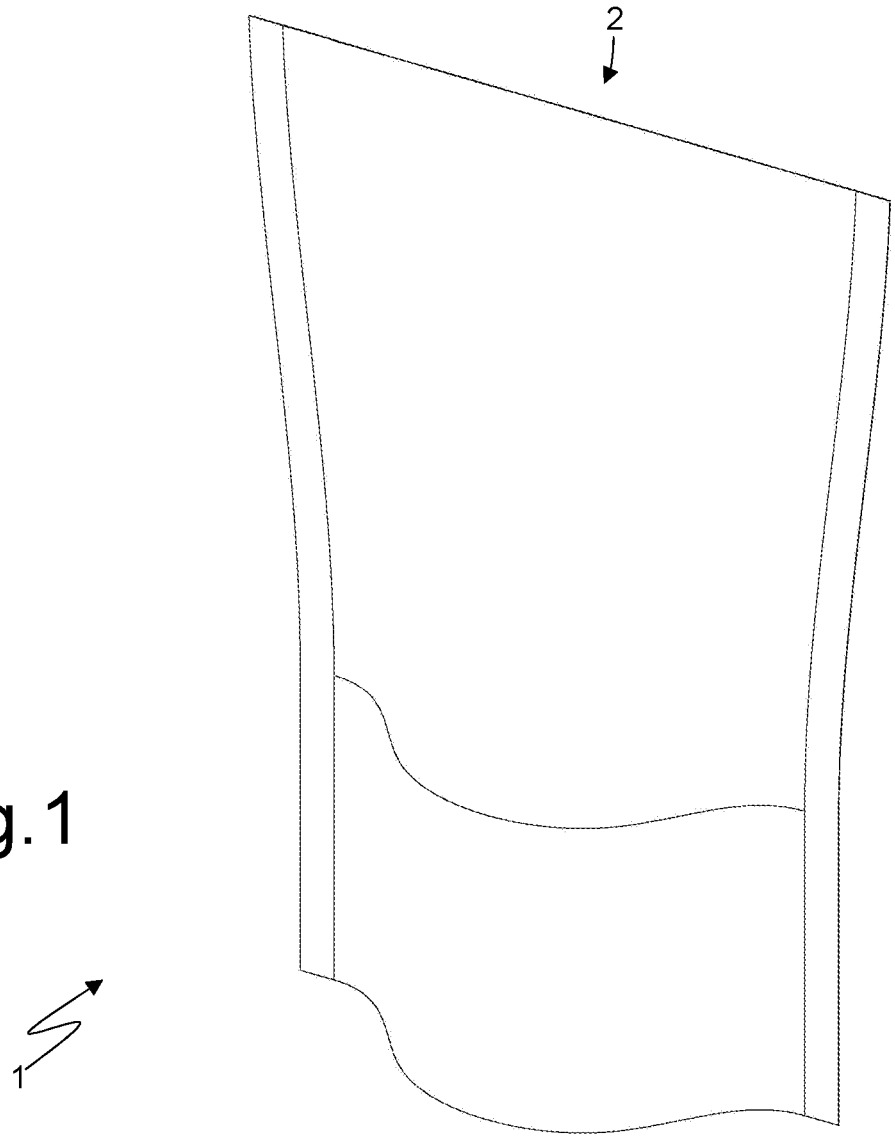
FIG. 1 is a perspective view of a bag made of heat-sealable material which contains inside a dose of a loose product.

FIG. 1 illustrates a bag 1 made of heat-sealable material which contains inside a dose of a loose product (i.e. one that does not have any cohesion, any adhesion among the parts which compose it and therefore does not have its own shape, such as a powder product, a grated product or a liquid product). The bag 1 has an upper end 2 that is initially open for the introduction of the dose of a loose product and is subsequently sealed through a transversal sealing.

Figure 2:
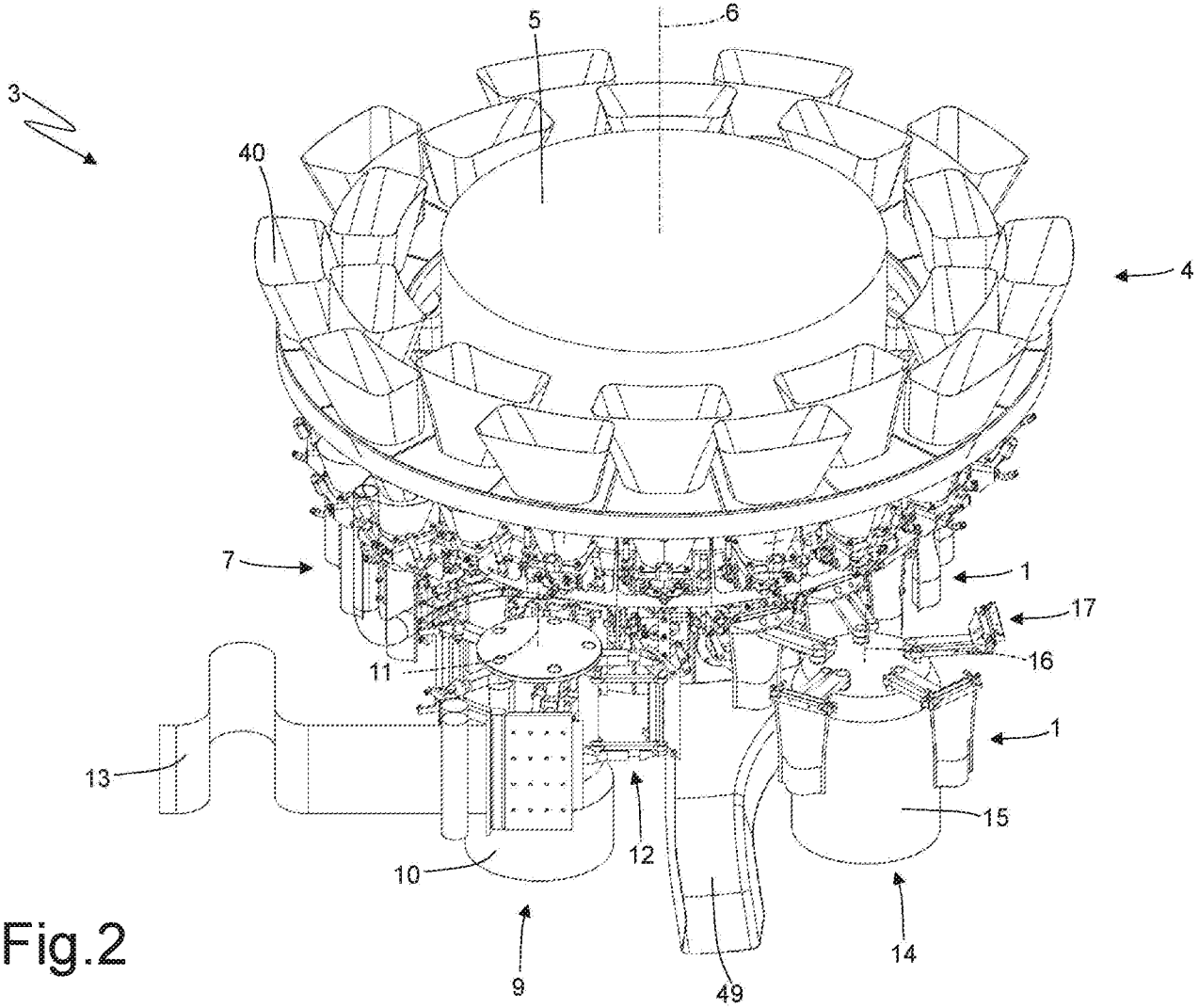
FIG. 2 is a perspective view, with some parts removed for clarity, of a packaging machine that carries out the filling and sealing of the bag of FIG. 1 and is made in accordance with the present invention.
Figure 3:
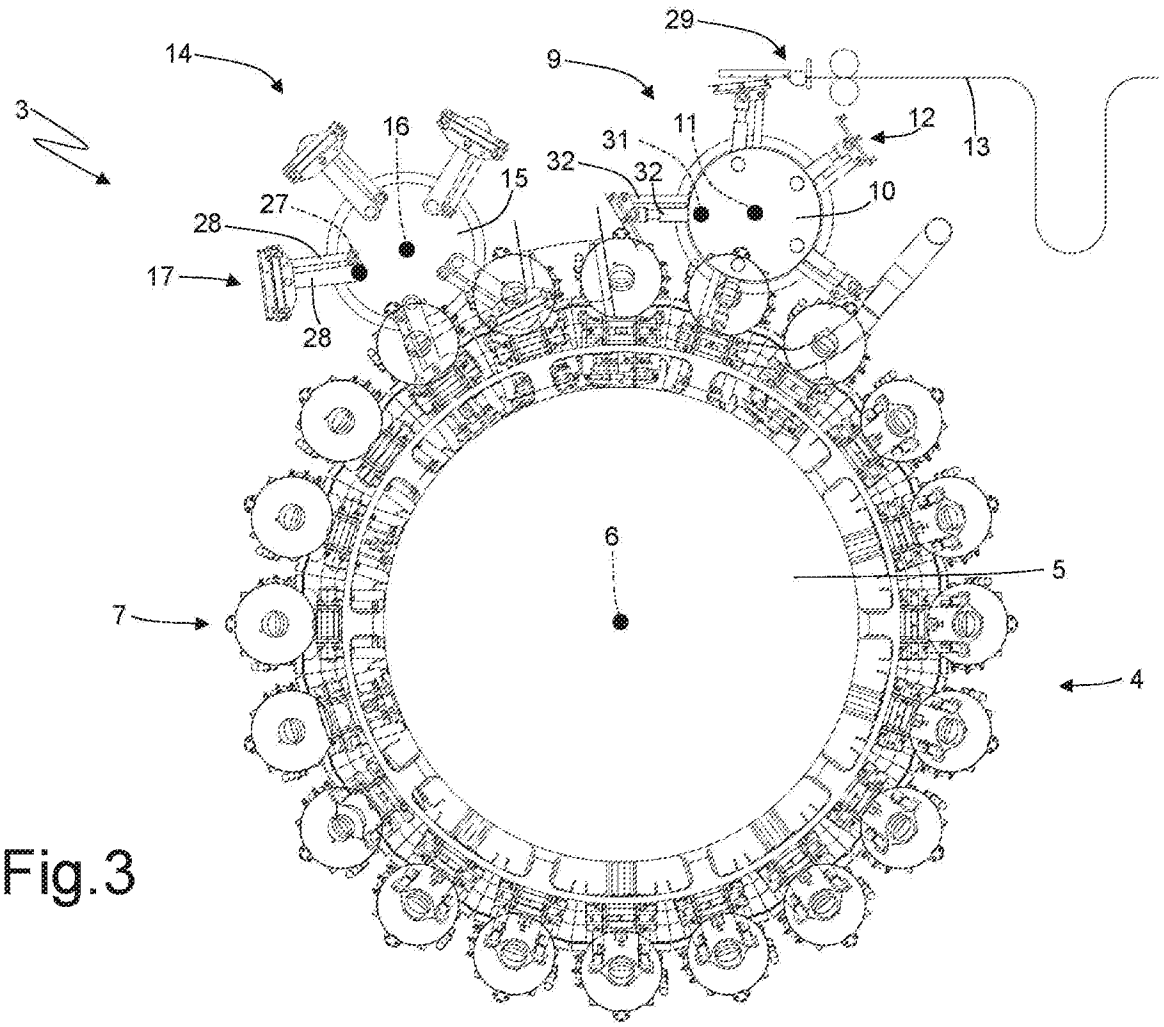
FIG. 3 is a plan view of the packaging machine of FIG. 2.

In FIGS. 2 and 3, the number 3 indicates as a whole an automatic packaging machine that carries out the filling and the sealing of the bag 1.

The packaging machine 3 comprises a packaging conveyor 4 provided with a drum 5 which is arranged horizontally and rotates with a continuous motion (that is, with a law of motion that has a continuous motion instead of alternating pauses and phases of motion) around a vertical rotation axis 6. The packaging conveyor 4 (i.e. the drum 5 of the packaging conveyor 4) supports a plurality of pick-up heads 7, which are arranged around the periphery of the drum 5. Each pick-up head 7 is advanced by the packaging conveyor 4 for feeding along a horizontal (i.e. lying on a horizontal plane) and circular packaging path P1 (illustrated in FIG. 4), and it is designed to grab and hold a corresponding bag 1 along the packaging path P1. The packaging path P1 is developed between an input station S1 (arranged at the beginning of the packaging path P1) in which the bags 1, empty and open at the top, are fed in succession to the corresponding pick-up head 7 (that is, in which each empty bag 1 is grabbed by the corresponding pick-up head 7) and an output station S2 (arranged at the end of the packaging path P1) in which the full and sealed bags are released in succession by the corresponding pick-up heads 7 (that is, in which each full and sealed bag 1 leaves the corresponding pick-up head 7). As more clearly shown in FIG. 5, each pick-up head 7 comprises at least a pair of clamps 8, which are opposite one another and are designed to grab opposite side ends of the corresponding bag 1.

As shown in FIGS. 2 and 3, the packaging machine 3 comprises a supplying conveyor 9, which is arranged next to the packaging conveyor 4 at the input station S1 (shown in FIG. 4) and is provided with a drum 10 that is arranged horizontally and rotates with continuous motion around a vertical rotation axis 11 and parallel to the rotation axis 6. The supplying conveyor 9 (that is the drum 10 of the supplying conveyor 9) supports a plurality of supplying heads 12, which are arranged around the periphery of the drum 10. Each supplying head 12 is advanced by the supplying conveyor 9 to advance along a horizontal (i.e. one that lies on a horizontal plane) and circular supplying path P2 (shown in FIG. 4) and is designed to grab and hold a corresponding bag 1 along the supplying path P2. The supplying path P2 is developed between a cutting station S3 (arranged at the beginning of the supplying path P2 and shown in FIG. 4) in which the empty and flattened bags 1 (i.e. having a flat shape in which the internal volume is substantially zeroed) are separated through a transverse cut from a continuous web 13 of preformed bags 1 and the input station S1 (arranged at the end of the supplying path P2 and shown in FIG. 4) in which each empty bag 1, open at the upper end, is cyclically transferred from a supplying head 12 of the supplying conveyor 9 to a pick-up head 7 of the packaging conveyor 4.

The packaging machine 3 comprises a stabilizing conveyor 14 (or cooling conveyor 14), that is arranged next to the packaging conveyor 4 at the output station S2 (shown in FIG. 4) and is provided with a drum 15 that is arranged horizontally and rotates with a continuous motion around a vertical rotation axis 16 and parallel to the rotation axis 6. The stabilizing conveyor 14 (i.e. the drum 15 of the stabilizing conveyor 14) supports a plurality of stabilizing heads 17, which are arranged around the periphery of the drum 15. Each stabilizing head 17 is advanced by the stabilizing conveyor 14 to advance along a horizontal (i.e. one that lies on a horizontal plane) and circular stabilizing path P3 (shown in FIG. 4) and is designed to grab and hold a corresponding bag 1 along the stabilizing path P3. The stabilizing path P3 is developed between the output station S2 (arranged at the beginning of the stabilizing path P3 and shown in FIG. 4) in which each full, sealed bag 1 is cyclically transferred from a pick-up head 7 of the packaging conveyor 4 to a stabilizing head 17 of the stabilizing conveyor 14 and a transfer station S4 (shown in FIG. 4) from which each full, sealed bag 1 leaves the stabilizing head 17 and continues towards an exit of the packaging machine 3.

Figure 6:
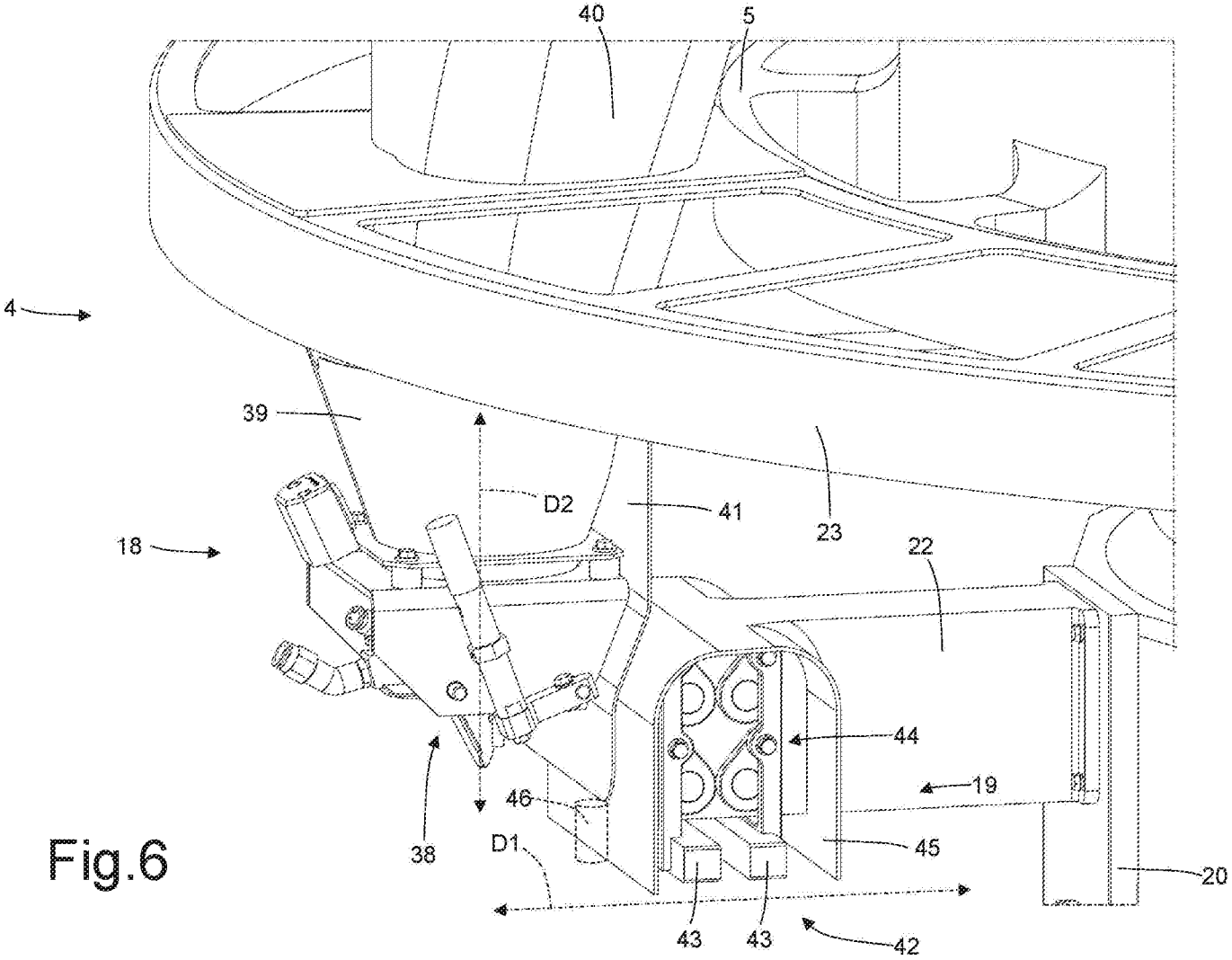
FIG. 6 is a perspective view, on an enlarged scale, of a filling device and of a sealing device of the packaging machine of FIG. 2.
Figure 7:
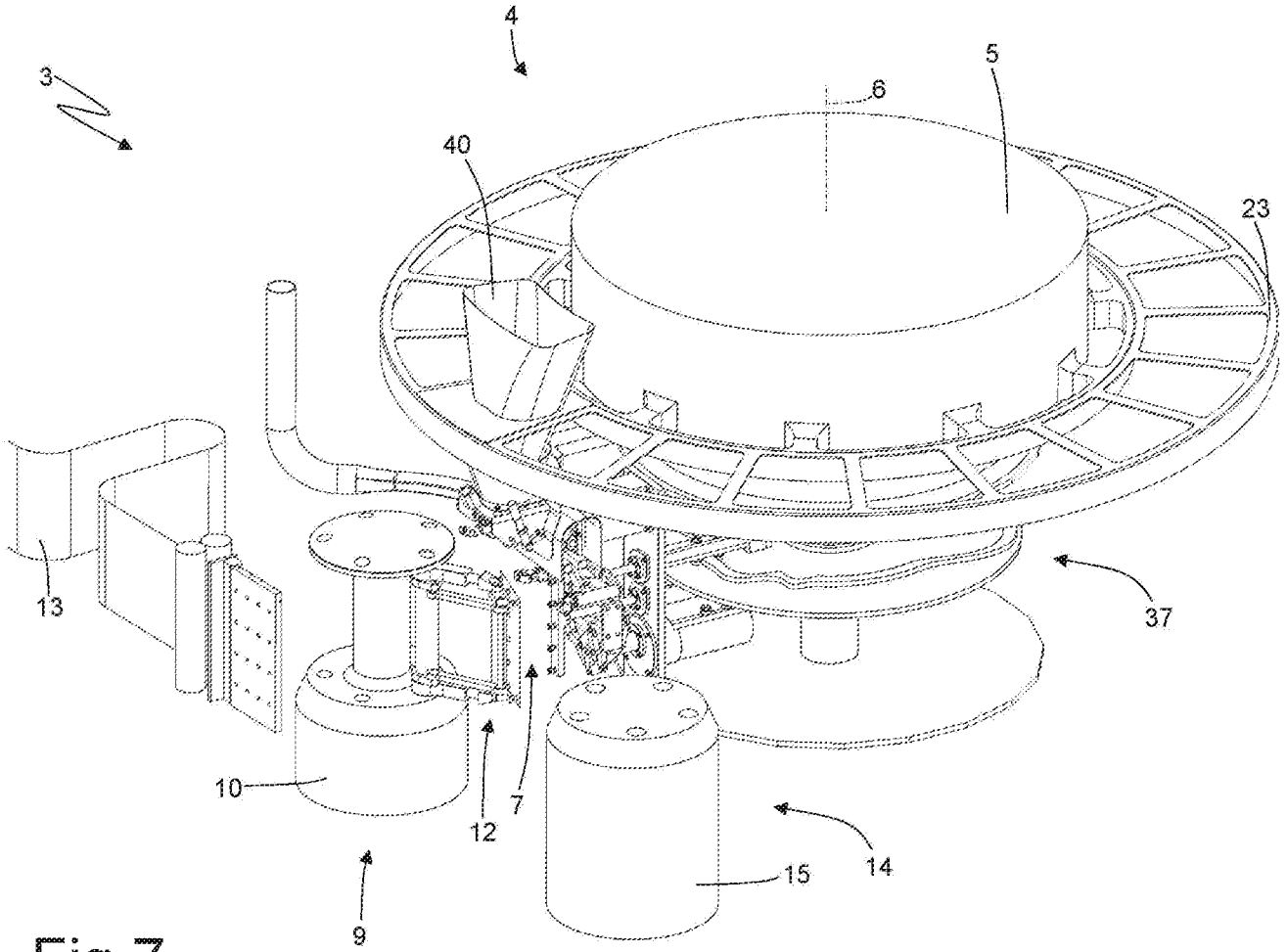
FIGS. 7-11 are a series of perspective views, with further parts removed for clarity, of the packaging machine of FIG. 2.
Figure 8:
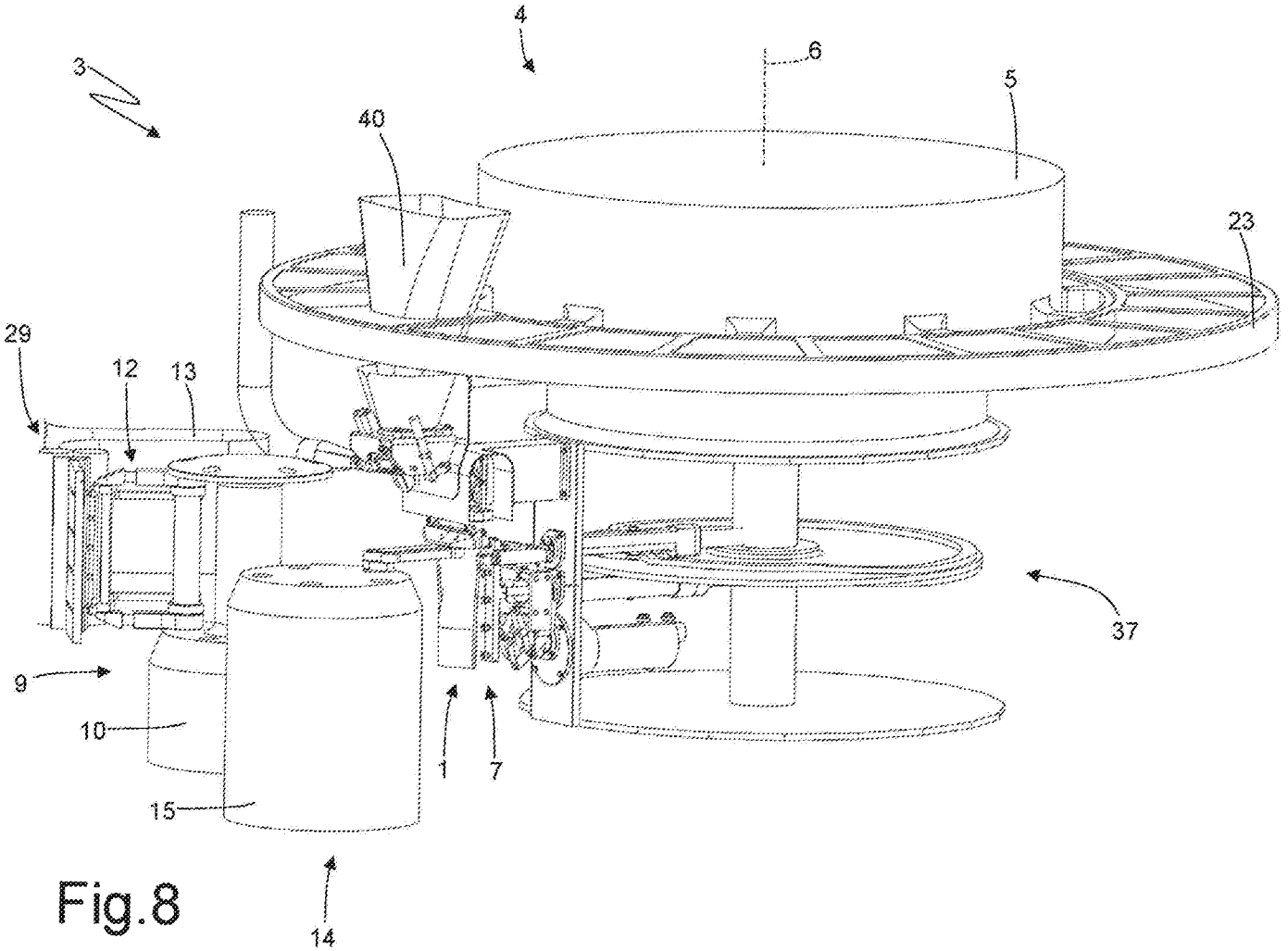
Figure 9:
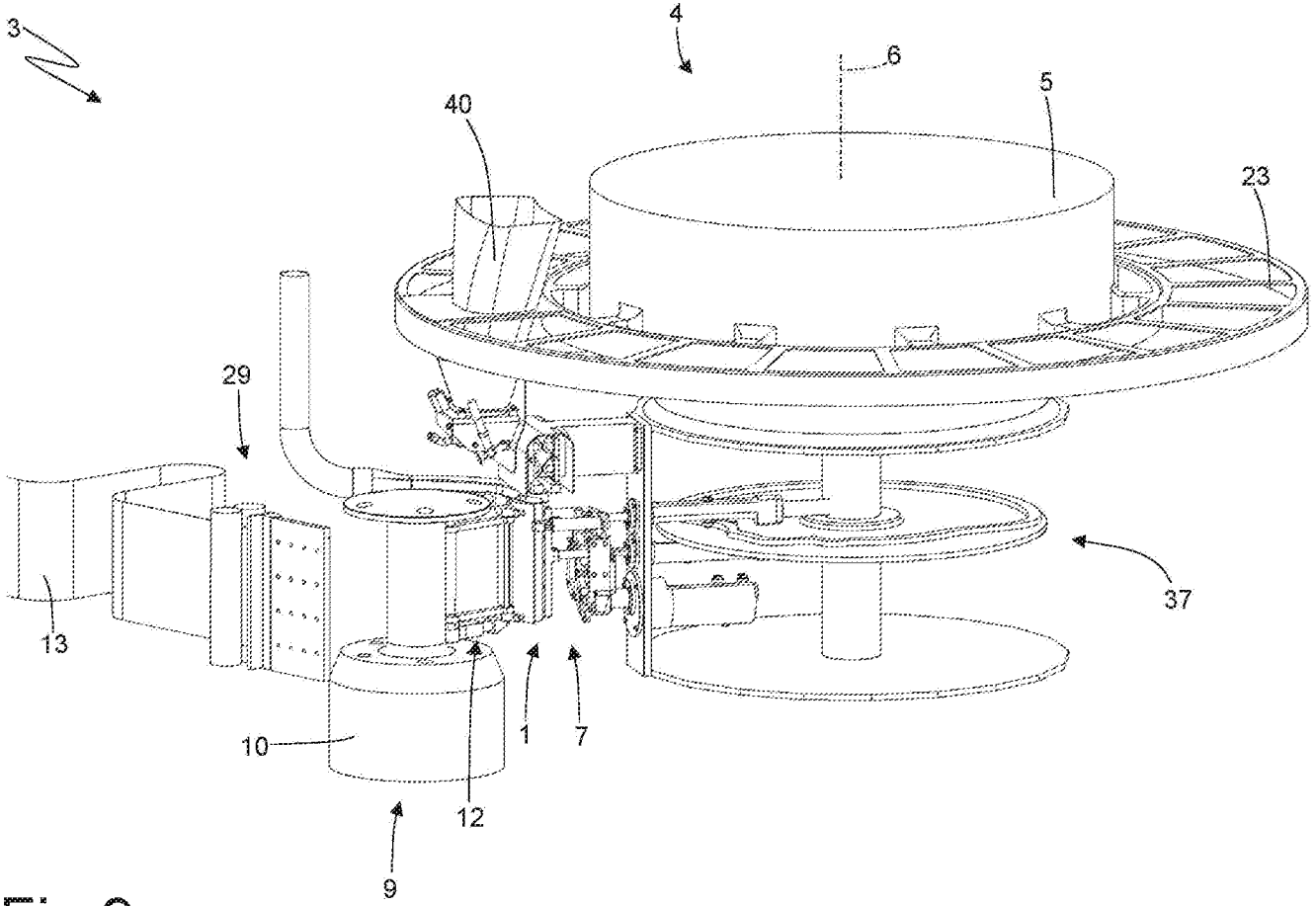

As shown more clearly in FIG. 6, the packaging machine 3 comprises a plurality of filling devices 18 (only one of which is shown in FIG. 6), each of which is supported by the drum 5 of the packaging conveyor 4 (so it is mounted movable along the packaging path P1), is coupled to a corresponding pick-up head 7, and is designed to feed, from above and through the upper open end 2, the dose of the product into a bag 1 carried by the same corresponding pick-up head 7. Moreover, the packaging machine 3 comprises a plurality of sealing devices 19 (only one of which is shown in FIG. 6), each of which is supported by the drum 5 of the packaging conveyor 4 (so it is mounted movable along the packaging path P1), is coupled to a corresponding pick-up head 7 and is designed to seal a full bag 1 carried by the corresponding pick-up head 7 through a sealing at the upper end 2. Therefore, to each pick-up head 7, a corresponding filling device 18 and a corresponding sealing device 19 are coupled, which are both mounted on the packaging conveyor 4, to move together with the pick-up head 7 along the entire packaging path P1.

It is important to note that, for each pick-up head 7, the sealing device 19 is near but in any case separate from the filling device 18 in such a way that the sealing is performed in a "clean" area, that is, as far as possible, free of product residues that can damage the execution of the sealing if they "dirty" the sealing area.

For each pick-up head 7, the corresponding filling device 18 and the corresponding sealing device 19 are arranged on the packaging conveyor 4, one beside the other and at a certain distance (that is at a determined distance) from each other along a direction D1 of horizontal selection (i.e. one that lies on a horizontal plane), arranged radially (perpendicularly) with respect to the rotation axis 6 and so transversely (perpendicularly) to the packaging path P1. Each pick-up head 7 is mounted movably on the packaging conveyor 4 for transferring along the selection direction D1 between a filling position F (shown in FIG. 4) in which the pick-up head 7 is aligned with the filling device 18 and a sealing position S (shown in FIG. 4) in which the pick-up head 7 is aligned with the sealing device 19; in other words, by transferring along the selection direction D1, the pick-up head 7 "selects" the filling position F or the sealing position S.

Figure 5:
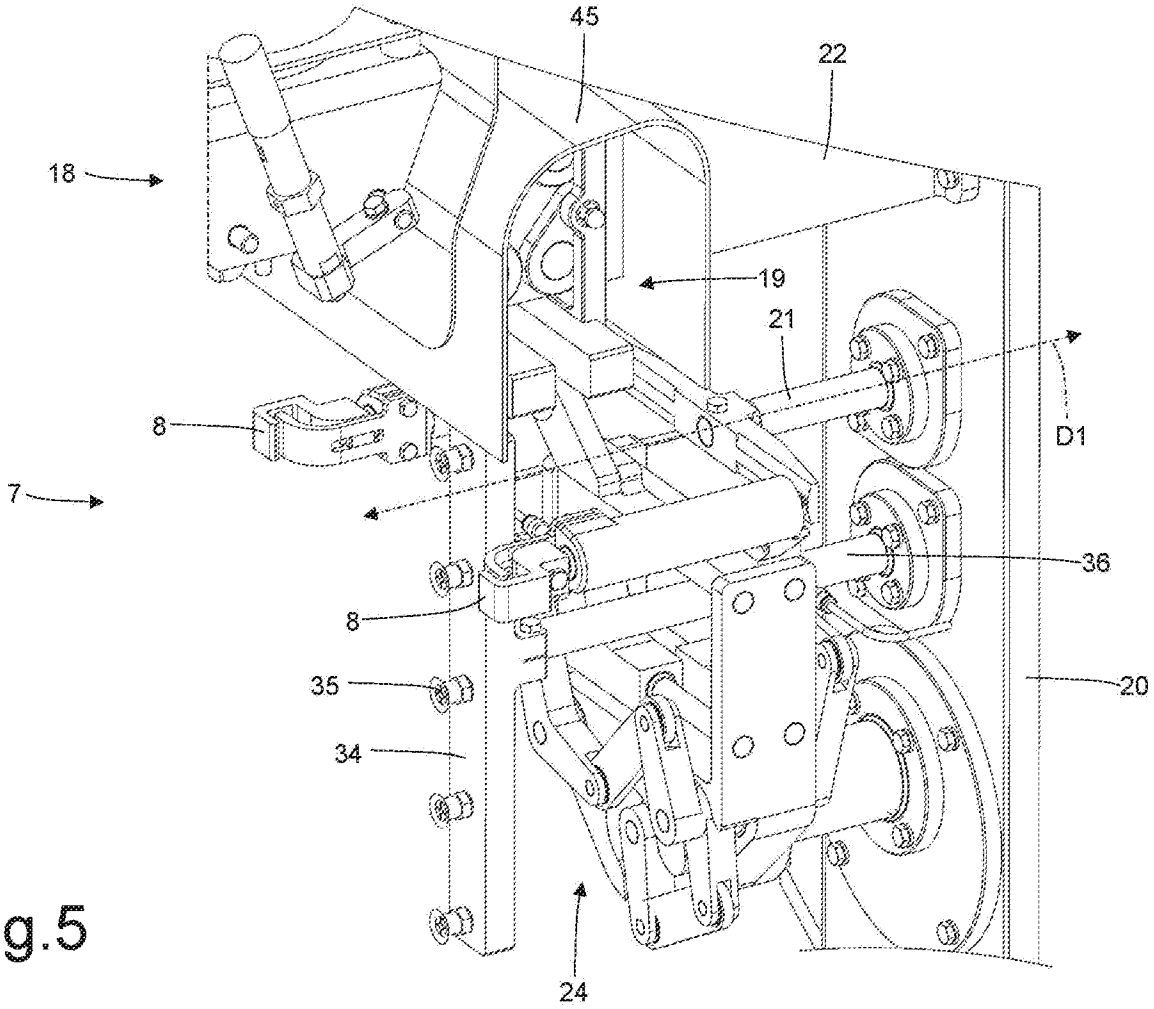
FIG. 5 is a perspective view, on an enlarged scale, of a pick-up head of the packaging machine of FIG. 2.

As shown more clearly in FIG. 5, the packaging conveyor 4 comprises a plurality of supporting plates 20 of rectangular shape (only one of which is illustrated in FIG. 5), each of which is rigidly mounted on the drum 5 of the packaging conveyor 4, is arranged vertically (so parallel to the rotation axis 6) and supports a corresponding pick-up head 7. In particular, for each pick-up head 7 a shaft 21 is provided, which is supported in a sliding manner by the supporting plate 20 to slide along the selection direction D1, and carries the same pick-up head 7. Consequently, each pick-up head 7 is mounted in a fixed angular position on the drum 5 of the packaging conveyor 4 in order to avoid its inclination varying with respect to the drum 5 itself.

Each supporting plate 20 also carries the corresponding sealing device 19 through a rigid bracket 22 which is bolted to the supporting plate 20 (that is, it is rigidly connected to the supporting plate 20); consequently, each sealing device 19 is mounted in a fixed position on the drum 5 of the packaging conveyor 4, that is, each sealing device 19 rotates together with the drum 5 and does not make any relative movement with respect to the drum 5 itself.

As shown more clearly in FIG. 6, the drum 5 of the packaging conveyor 4 comprises a perforated ring 23, which is arranged around the drum 5 and supports the filling devices 18. The ring 23, which carries the filling devices 18, is arranged above the supporting plates 20 that carry the pick-up heads 7 and so each filling device 18 is arranged above the corresponding pick-up head 7 to feed the product from above into the bags 1 carried by the pick-up heads 7. The ring 23 is rigidly bound to the drum 5 of the packaging conveyor 4 and so the filling devices 18 are angularly built into the drum 5 of the packaging conveyor 4.

Figure 10:
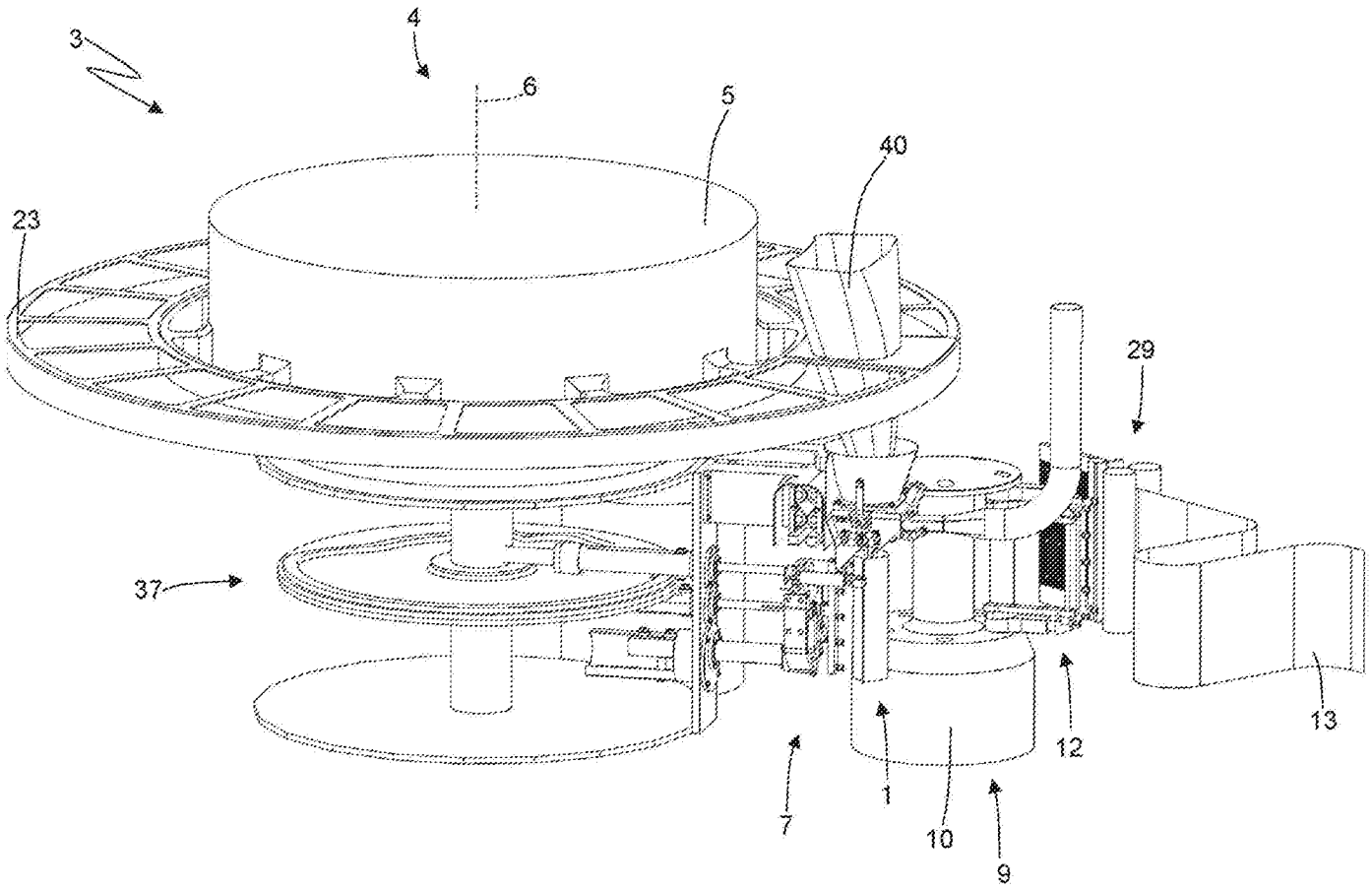
Figure 11:
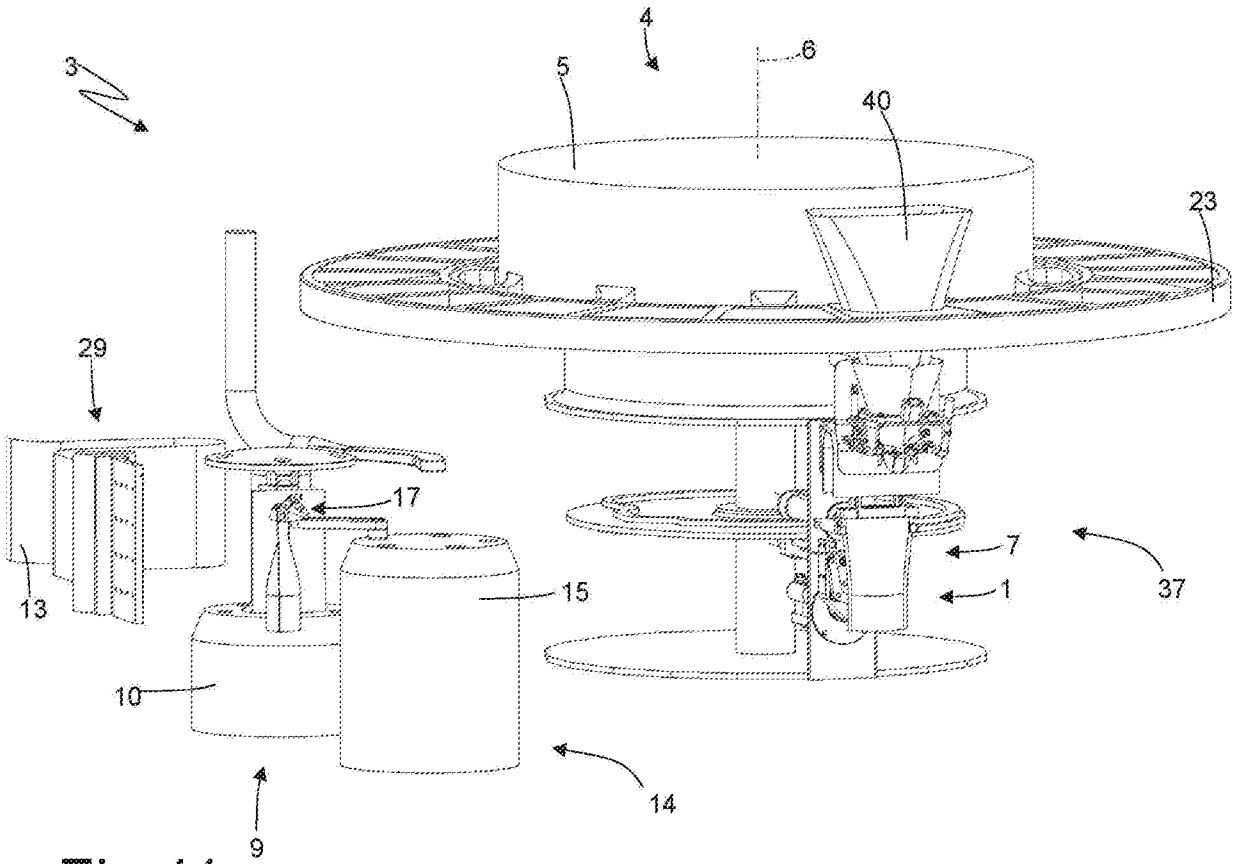

Each filling device 18 is mounted movably on the ring 23 (so on the drum 5 of the packaging conveyor 4) for transferring between a rest position (higher up and shown in FIGS. 6-9 and 11) and a working position (lower down and shown in FIG. 10) along a vertical working direction D2 that is parallel to the rotation axis 6 and is perpendicular to both the selection direction D1 and the packaging path P1. Each filling device 18 is normally maintained in the rest position and is arranged in the working position only during the filling of a bag 1 carried by the corresponding pick-up head 7.

As shown in FIG. 5, in each pick-up head 7, the two clamps 8 are movable to move closer to and away from each other under the control of a substantially known type of actuator device 24 (e.g. as described in the patent application EP2853497A1) which is driven through fixed cams (partly visible in FIGS. 7-11) and are arranged inside the drum 5 of the packaging conveyor 4. The movement that each actuator device 24 gives to the two clamps 8 is adjustable by varying the axial position of the fixed cams in order to adapt the movement itself to the format (that is, to the real size) of the bags 1. In use, the two clamps 8 of each pick-up head 7 are mutually arranged at a greater distance to the input station S1 when the corresponding bag 1 is empty and in a flattened configuration (that is, with the opposite edges of the open upper end 2 in close mutual contact) and get closer as the empty bag 1 passes from the flattened configuration to an open configuration (or as the opposite edges of the open upper end 2 are moved apart), thus following the deformation of the bag 1 that is necessary in order to open the bag 1 itself. In fact, for obvious geometric constraints (the bags 1 are flexible but not deformable) a bag 1 can pass from the flattened configuration to the open configuration (that is, the opposite edges of the open upper end 2 can be moved apart) only if the two sides of the bag 1 (tightened by the two clamps 8 of the corresponding pick-up head 7) get closer.

Figure 13:
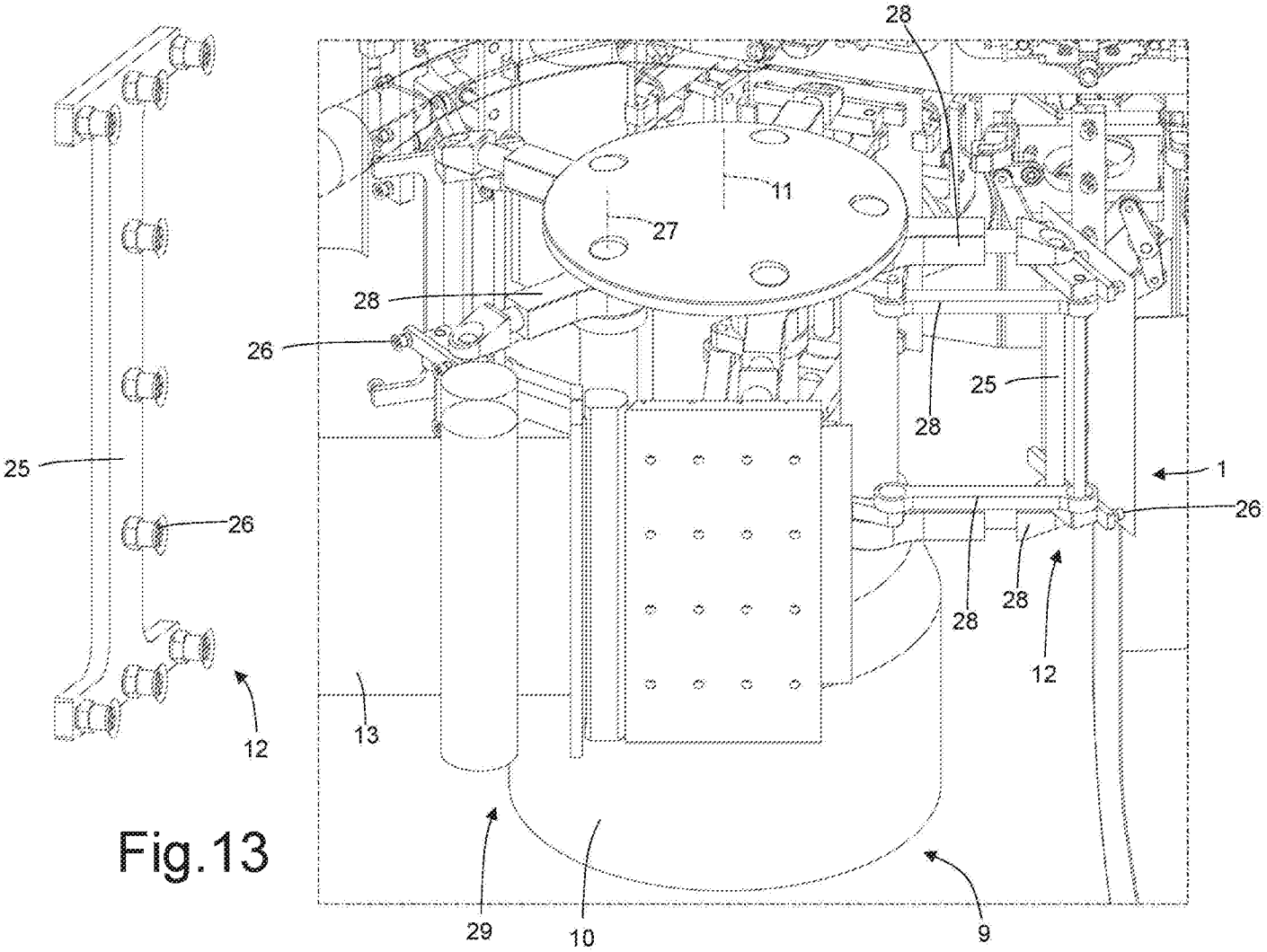
FIG. 13 is a perspective view, on an enlarged scale, of a supplying conveyor of the packaging machine of FIG. 2.

As shown in FIGS. 3 and 13, each supplying head 12 comprises an "I"-shaped rigid body 25 that carries a plurality of suction cups 26, which are designed to retain, by suction, an empty and flattened bag 1. It is important to note that each supplying head 12 (i.e. the rigid body 25 of the supplying head 12) is adapted to engage an empty and flattened bag 1 at different points with respect to the points engaged by the two clamps 8 of a pick-up head 7 in such a way that a bag 1, in the input station S1, can be at the same time engaged by a supplying head 12 and a pick-up head 7. Each supplying head 12 is rotary mounted on the drum 10 of the supplying conveyor 9 to rotate with respect to the drum 10 itself around a rotation axis 27 parallel to the rotation axis 11 due to the action of a cam actuation system. In use, each supplying head 12 rotates with respect to the drum 10 in the opposite direction with respect to the rotation direction of the drum 10 itself when it is located in the input station S1 to stay for a certain time facing and parallel to a corresponding pick-up head 7 of the packaging conveyor 4, and so allow an easy transfer of an empty bag 1 from the supplying head 12 to the pick-up head 7. According to a preferred, but not binding, embodiment shown in the annexed figures, each supplying head 12 is connected to the drum 10 of the supplying conveyor 9 by means of a pair of upper arms 28 and a pair of lower arms 28 (identical to the upper arms 28, not shown in FIG. 3). Each arm 28 is hinged at an end to the drum 10 of the supplying conveyor 9 and is hinged at the opposite end to the supplying head 12 in such a way that a pair of arms 28 forms with the supplying head 12 and with the drum 10 an articulated quadrilateral.

In the cutting station S3 a cutting device 29 is provided, which separates in succession each bag 1 from the continuous web 13 of preformed bags 1 and provides the bag 1 to a corresponding supplying head 12 of the supplying conveyor 9.

Figure 12:
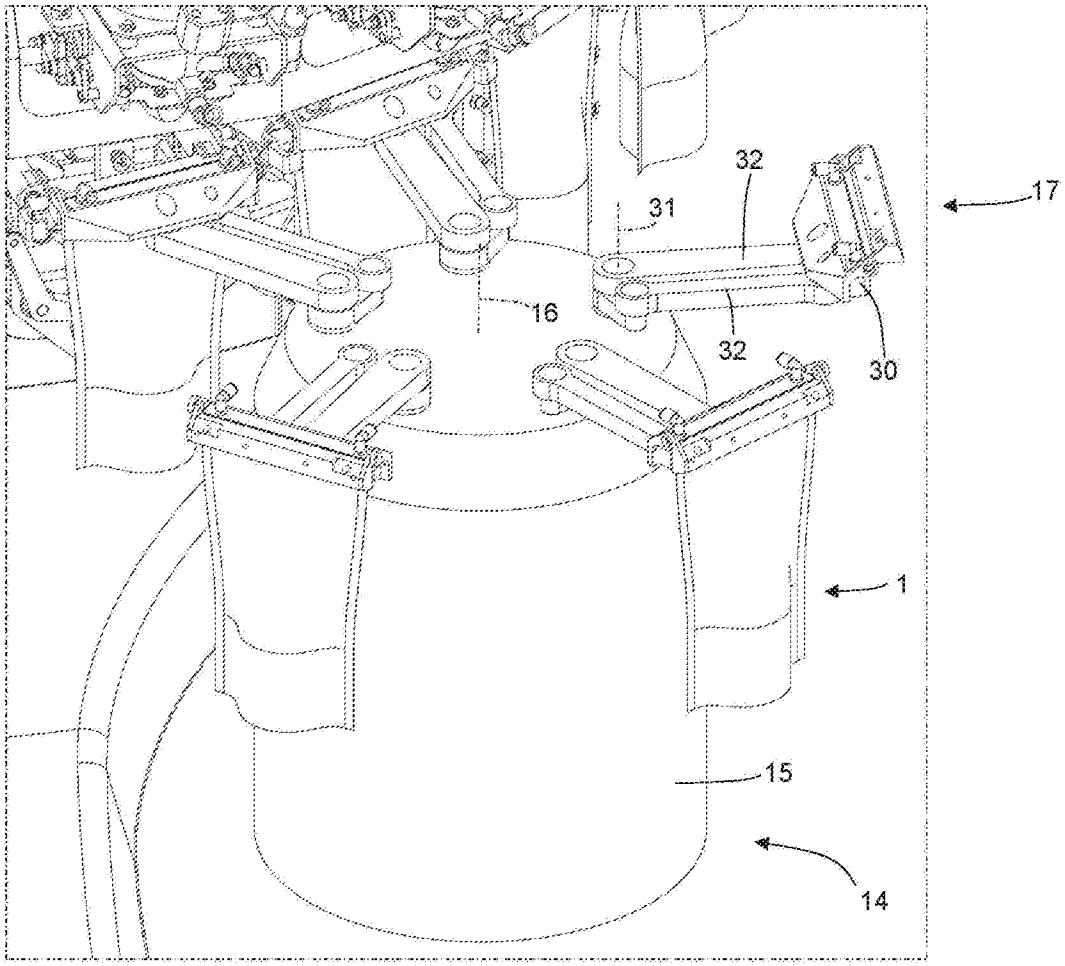
FIG. 12 is a perspective view, on an enlarged scale, of a stabilizing conveyor of the packaging machine of FIG. 2.

As shown in FIGS. 3 and 12, each stabilizing head 17 comprises a single clamp 30, which is oriented perpendicularly to the clamps 8 of the pick-up heads 7, and is designed to grab a respective full, sealed bag 1 at the upper end 2. In this way, each clamp 30 squeezes the upper end 2 of the bag 1 at the recently executed heat-seal, allowing the heat-seal to cool without the possibility of unwanted detachments of the recently sealed material. Consequently, the stabilizing conveyor 14 allows the recently performed heat-seal to stabilize without any danger of unwanted detachments of the recently sealed material. It is important to note that each stabilizing head 17 (i.e. the clamp 30 of the stabilizing head 17) is adapted to engage a full, sealed bag at different points other than the points engaged by the two clamps 8 of a pick-up head 7 in such a way that a bag in the output station S2 can be engaged at the same time by a stabilizing head 17 and by a pick-up head 7. Each stabilizing head 17 is rotary mounted on the drum 15 of the stabilizing conveyor 14 so as to rotate with respect to the drum 15 itself around a rotation axis 31 parallel to the rotation axis 16 due to the action of a cam actuation system. In use, each stabilizing head 17 rotates with respect to the drum 15 in the opposite direction with respect to the rotation direction of the drum 15 itself, when it is in the output station S2 to remain for a certain time facing and parallel to a corresponding pick-up head 7 of the packaging conveyor 4, and so allow an easy transfer of an empty bag 1 from the pick-up head 7 to the stabilizing head 17. According to a preferred, but not binding, embodiment shown in the annexed figures, each stabilizing head 17 is connected to the drum 15 of the stabilizing conveyor 14 through a pair of arms 32. Each arm 32 is hinged at one end to the drum 15 of the stabilizing conveyor 14 and is hinged at the opposite end to the stabilizing head 17 in such a way that the pair of arms 32 forms with the stabilizing head 17 and with the drum 15 an articulated quadrilateral.

As better shown in FIG. 5, each pick-up head 7 is coupled to a corresponding opening device 33, which is carried by the corresponding supporting plate 20 and acts in the input station S1 to open a corresponding bag 1 moving away from each other the two opposite edges of the upper end 2 of the bag 1 itself (as previously mentioned, the deformation of the bag 1 in order to separate the two opposite edges of the upper end 2, is accompanied by a progressive mutual approach of the two clamps of the pick-up head 7. Each opening device 33 comprises a body 34, which is provided with a series of suction cups 35, is arranged between the two clamps 8 of the pick-up head 7 and is mounted movable on the supporting plate 20 to transfer along the selection direction D1 as an effect of a cam actuation system. According to an alternative and perfectly equivalent embodiment, the body 34 moves along the selection direction D1 due to the action of a dedicated electric motor. This solution allows a greater flexibility of the law of motion of the body 34, since the same law of motion can be modified via software (by simplifying the format change operations and enabling a better optimization of the opening operation of the bags 1). In particular, for each opening device 33 a shaft 36 is provided, which is supported in a sliding way by the supporting plate 20 to slide along the selection direction D1, and carries the opening device 33 itself. The sliding of the shaft 36 (that is, of the opening device 33) along the selection direction D1 is controlled by a cam actuation system. In use, when a pick-up head 7 is located in the input station S1 and receives an empty and flattened bag 1, the corresponding opening device 33 is arranged in a radially extracted position (that is, it is arranged towards the outside) in such a way that its suction cups 35 engage (retaining by suction) a surface of the bag 1 whereas the other opposite surface of the bag 1 is still engaged (retained by suction) by the suction cups 26 of the corresponding supplying head 12. Thus, the opening device 33 is moved along the selection direction D1 towards a radially retracted position (that is, inwardly) to move the surface of the bag 1 retained by the opening device 33 away from the other opposite surface of the bag retained by the corresponding supplying head 12 causing the opening of the bag 1 (i.e. by separating the opposite edges of the upper end 2). As previously said, the opening of the bag 1 is accompanied by a mutual approach of the two clamps 8 of the pick-up head 7 that is necessary to allow the bag 1 to deform in order to allow the two opposite edges of the upper end 2 to move away from each other.

According to a possible embodiment, each opening device 33 also comprises one or more nozzles, which are arranged above the corresponding pick-up head 7 (that is, above the corresponding bag 1) and are designed to direct the jets of compressed air directed vertically towards the upper end 2 of the bag to facilitate the mutual separation of the two edges opposite to the upper end 2 itself.

Figure 4:
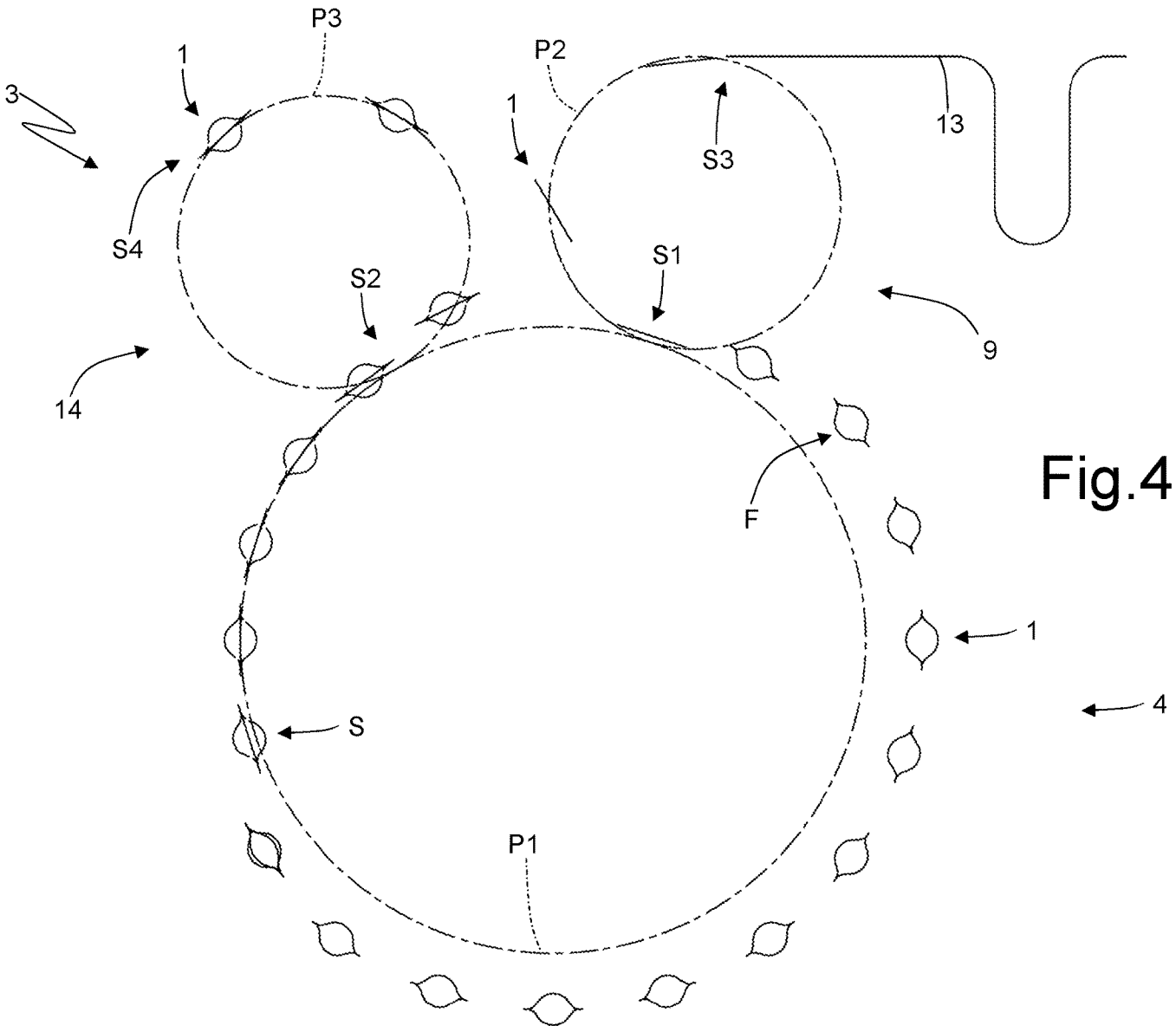
FIG. 4 is a schematic and plan view of the packaging machine of FIG. 2.

As shown in FIG. 4, the packaging machine 3 comprises a cam actuating device 37 (partially shown in FIGS. 7-11) that moves each pick-up head 7 along the selection direction D1, puts in the input station S1 the pick-up head 7 in the sealing position S, downstream of the input station S1 it moves the pick-up head 7 outwards to place the pick-up head 7 in the filling position F to perform the filling of the bag 1, and then it moves the pick-up head 7 inwards in order to put the pick-up head 7 again in the sealing position S (which is maintained until the output station S2) to perform the heat-sealing of the open upper end 2 of the bag 1.

As shown in FIG. 6, each filling device 18 comprises an opening 38 which is arranged lower down (i.e. towards the corresponding pick-up head 7) and through which the product that fills the bags 1 comes out. The opening 38 receives the product from a movable hopper 39 that moves together with the opening 38 along the vertical working direction D2 between the rest position (higher up and shown in FIGS. 6-9 and 11) and the working position (lower down and shown in FIG. 10). The movable hopper 39 is coupled to a fixed hopper 40, which is arranged higher up the movable hopper 39 and is rigidly mounted on the ring 23; essentially, the two hoppers 39 and 40 interpenetrate each other and together form a telescopic system that follows the movement along the vertical working direction D2 of the opening 38. As shown in FIG. 6, each filling device 18 comprises a screen 41, which is movable together with the opening 38 along the vertical working direction D2 and is arranged between the filling device 18 and the sealing device 19.

According to a preferred embodiment, each filling device 18 comprises at least one nozzle, which is arranged at the opening 38 and injects into the bag 1 an inert gas (typically nitrogen) at the same time with the feeding of the product to reduce the content of oxygen inside the bag 1 itself.

As shown in FIG. 6, each sealing device 19 comprises a sealing clamp 42 that squeezes the bag 1 at the open upper end 2 and is composed of two heated jaws 43 (typically through respective thermistors embedded in the jaws 43) and of a handling mechanism 44 which is driven by the cams and moves the sealing clamp 42 between a rest position (shown in FIGS. 6-10) in which the sealing clamp 42 is relatively far away from the bag 1 carried by the corresponding pick-up head 7 and a working position (shown in FIG. 11) in which the sealing clamp 42 engages (squeezes) the upper end 2 of the bag 1 carried by the corresponding pick-up head 7. Essentially, each handling mechanism 44 gives to the sealing clamp 42 a vertical movement (through which the sealing clamp 42 moves towards or away from the bag 1), and a horizontal movement (through which the sealing clamp 42 closes or opens in order to squeeze or release the bag 1). According to a preferred embodiment shown in FIG. 6, each sealing device 19 comprises a screen 45, which is rigidly connected to the rigid bracket 22 and is adapted to a "U" shape.

According to a different embodiment not shown, when the bags 1 are provided with a central screwed-on cap, each sealing device 19 comprises, in addition to the sealing clamp 42, which performs a transverse heat-seal at the upper end 2 of each bag 1, also a further sealing clamp, which performs a transverse heat-seal at the cap; when used, the two sealing clamps of the sealing device 19 operate in succession (that is, first one and then the other) to perform the two transverse heat-seals which are mutually parallel and spaced apart.

According to a preferred embodiment shown in FIG. 2, a waste chute 49 is provided, which is arranged at the output station S2 below the packaging conveyor 4 and is designed to receive and convey by gravity a defective bag 1 that in the output station S2 is released from the corresponding pick-up head 7. In other words, when a bag 1 is identified as defective (i.e. it is identified as to be discarded), in the output station S2, the bag 1 itself is not grabbed by a stabilizing head 17 of the stabilizing conveyor 14 and then, when in the output station S2 it is released from the corresponding pick-up head 7 of the packaging conveyor 4, it falls down through gravity landing on the underlying waste chute 49 that ends in a container of discarded (defective) bags 1.

According to a preferred embodiment shown schematically in FIG. 6, each pick-up head 7 is provided with a micro-wave control device 46 which is mounted on the filling device 18 or on the sealing device 19 and is designed to detect the presence of product at the open upper end 2 of the bag 1, where the heat-sealing must be performed: a bag 1 is identified as defective if the corresponding microwave control device 46 detects the presence (beyond a certain threshold) of the product at the open upper end 2 of the bag 1, where the heat-sealing must be performed (in fact, a significant presence of product at the area that must be sealed negatively interferes with the sealing process, preventing the obtaining of a good quality heat-seal and therefore it inevitably makes the bag 1 defective).

What follows is a description of the functioning of the packaging machine 3 described above with reference to the packaging of a single bag 1 and with reference to what is shown in FIG. 4.

Initially, the empty and flattened bag 1 (i.e. with the opposite edges of the upper end 2 in close mutual contact) is an integral part of the continuous web 13 of the preformed bags 1, from which it is separated by a transversal cut by the cutting device 29 arranged in the cutting station S3; immediately after it has been separated from the continuous web 13 of the preformed bags 1, the empty and flattened bag 1 is engaged by a supplying head 12 of the supplying conveyor 9. Subsequently, the supplying conveyor 9 moves the supplying head 12 that carries the empty and flattened bag 1 towards the input station S1 in which the empty and flattened bag 1 is transferred from the supplying head 12 of the supplying conveyor 9 to a pick-up head 7 of the packaging conveyor 4.

In the input station S1, the empty and flattened bag 1 is engaged at the same time by the supplying head 12 of the supplying conveyor 9 (whose suction cups 26 are annexed to a surface of the empty and flattened bag 1), from the two clamps 8 of the pick-up head 7, and also from the opening device 33 (whose suction cups 35 are annexed to a surface of the empty and flattened bag 1 opposite to the surface engaged by the supplying head 12); Starting from this situation, the opening device 33 moves away from the supplying head 12 by sliding (radially) along the selection direction D1 to separate the two opposite edges of the upper end 2 and thus determine the opening of the empty bag 1 (as previously mentioned, the opening of the empty bag 1 is followed by a reciprocal approaching movement of the two clamps 8 of the pick-up head 7). Once completed the opening of the empty bag 1, the supplying head 12 of the supplying conveyor 9 and the opening device 33 detach from the empty and open bag 1 leaving the empty and open bag 1 only to the clamps 8 of the pick-up head 7.

In the input station S1, the pick-up head 7, while it receives the empty and flattened bag 1 from the supplying head 12 of the supplying conveyor 9, is located in the sealing position S.

While the packaging conveyor 4 advances the empty and open bag 1 carried by the pick-up head 7 along the packaging path P1, the pick-up head 7 slides radially along the selection direction D1 to move the empty and open bag 1 into the filling position F (i.e. below the filling device 18). Therefore, the filling device 18 moves downward along the working direction D2 (from the rest position to the working position) to insert the opening 38 itself into the open upper end 2, and so perform the insertion of the dose of the product into the empty and open bag 1. At the end of the filling of the bag 1, the filling device 18 moves upwards along the working direction D2 (from the working position to the rest position) to release the full and open bag 1; therefore, the pick-up head 7 slides radially along the selection direction D1 to move the full and open bag 1 to the sealing position S (i.e. below the sealing device 19), always while the packaging conveyor 4 moves the full and open bag 1 carried from the pick-up head 7 along the packing path P1.

At this point, the sealing device 19 moves from the rest position to the working position (in which the sealing clamp 42 engages the upper end 2 of the bag 1 carried from the pick-up head 7) for executing the heat-sealing of the upper end 2, always while the packaging conveyor 4 advances the bag 1 carried by the pick-up head 7 along the packaging path P1. At the end of the heat-sealing of the bag 1, the sealing device 19 moves from the working position to the rest position and when the pick-up head 7 carrying the full and sealed bag 1 arrives in the output station S2 the full and sealed bag 1 is transferred from the pick-up head 7 of the packaging conveyor 4 to a stabilizing head 17 of the of the stabilizing conveyor 14. As previously said, if the full and sealed bag 1 has been identified as defective, then in the output station S2 the stabilizing head 17 does not close to grab the full and sealed bag 1, and so the full and sealed bag 1 itself falls through gravity towards the waste chute 49.

According to a possible not shown embodiment, the packaging machine 3 comprises a plurality of feeder devices, each of which is supported by the drum 5 of the packaging conveyor 4 (so mounted movable along the packaging path P1), is coupled to a corresponding pick-up head 7 and designed to put a cap on a bag 1 carried by the corresponding pick-up head 7 itself.

From the above description, it is evident that each pick-up head 7 of the conveyor 4 has an associated group of operative members interacting with the pick-up head 7 (or rather with the bag 1 carried by the pick-up head 7). The group of operational members associated with each pick-up head 7 comprises the corresponding filling device 18, the corresponding sealing device 19, the corresponding feeder device, if present, and, in general, any other element that works in conjunction with the pick-up head 7 and only with the pick-up head 7. In other words, the group of operative members associated with each pick-up head 7 comprises all and only the operative members (filling device 18, sealing device 19, possible feeder device . . . ) that cooperate with the pick-up head 7 and only with the pick-up head 7 itself (that is, not with the other pick-up heads 7).

According to a possible embodiment, the packaging machine 3 implements a control mode that is to detect the proper functioning of each pick-up head 7 and/or all operative members associated therewith, so as to identify a failing pick-up head 7; in other words, a pick-up head 7 is identified as failing when a problem is detected (i.e., a malfunction) directly in the pick-up head 7 or indirectly in one of the operative members associated with the pick-up head 7. Therefore, a pick-up head 7 is identified as failing when the pick-up head 7 cannot assure the proper performance of all operations over a bag 1 (because there is a problem in the pick-up head 7 or because there is a problem in one of the operative members associated therewith).

In the absence of failing pick-up heads 7, that is, under normal conditions, all the pick-up heads 7 are used to fill the bags 1, with a corresponding bag 1 being always fed to each pick-up head 7 in the input station S1 and running, for all the pick-up heads 7 all the filling and sealing operations described above.

When a failing pick-up head 7 is removed (due to a problem directly in the pick-up head 7 or a problem in one of the operative members associated therewith), it is possible to stop the packaging machine 3, by completely interrupting the packaging of the bags 1 and remaining waiting for a technical intervention (cleaning, maintenance, repair, replacement . . . ). This option is certainly simple, but by contrast reduces significantly the long-term productivity of the packaging machine 3, or the number of bags 1 properly packaged in a long period of time (e.g., a work shift conventionally of 8 hours, a working day, a working week, a working month, a working year . . . ) especially when the malfunction is trivial and relatively frequent (such as a simple blockage in one filling device 18).

Alternatively, when a failing pick-up head 7 is removed (due to a problem directly in the pick-up head 7 or a problem in one of the operative members associated therewith) it is possible to keep the packaging machine 3 operative, using only the pick-up heads 7 functioning properly for filling the bags 1 (that is, avoiding the use of only the failing pick-up head 7). From a practical point of view, this is accomplished by feeding each properly functioning pick-up head 7 a corresponding empty bag 1 in the input station S1, avoiding the feeding of the failing pick-up head 7 a corresponding empty bag 1 in the input station S1, and avoiding the operation of at least the filling device 18 associated with the failing pick-up head 7. In other words, when the failing pick-up head 7 is located in the input station S1, it does not receive an empty bag 1 and the filling device 18 that is associated with the failing pick-up head 7 is never operated.

The sealing device 19 associated with a failing pick-up head 7 is preferably disabled (i.e. is never activated). Alternatively, the sealing device 19 associated to the failing pick-up head 7 might also be left in operation, as welding "nothing" does not cause any damage (but wastes some energy).

Any device attached to a failing pick-up head 7 is necessarily disabled (i.e. is never operated).

In general, the operative members that are associated with a failing pick-up head 7 and feeding anything (a portion of product, a cap . . . ) are necessarily disabled (that is, they are never activated), while the operative members that are associated with a failing pick-up head 7 and not feeding anything can be deactivated or can be left to operate.

This mode of operation allows not completely stopping the packaging machine 3 when a failing pick-up head 7 is detected. In fact, the packaging machine 3 continues to operate in an almost normal mode with minimal disadvantage due to momentary "loss" of a pick-up head 7 (in the packaging machine 3 shown in the figures attached, the packaging conveyor 4 comprises twenty pick-up heads 7, hence the temporary "loss" of a pick-up head 7 represents a very insignificant limitation, especially when compared to machine downtime). In this way, it is possible to increase significantly the long-term productivity of the packaging machine 3.

Figure 14:
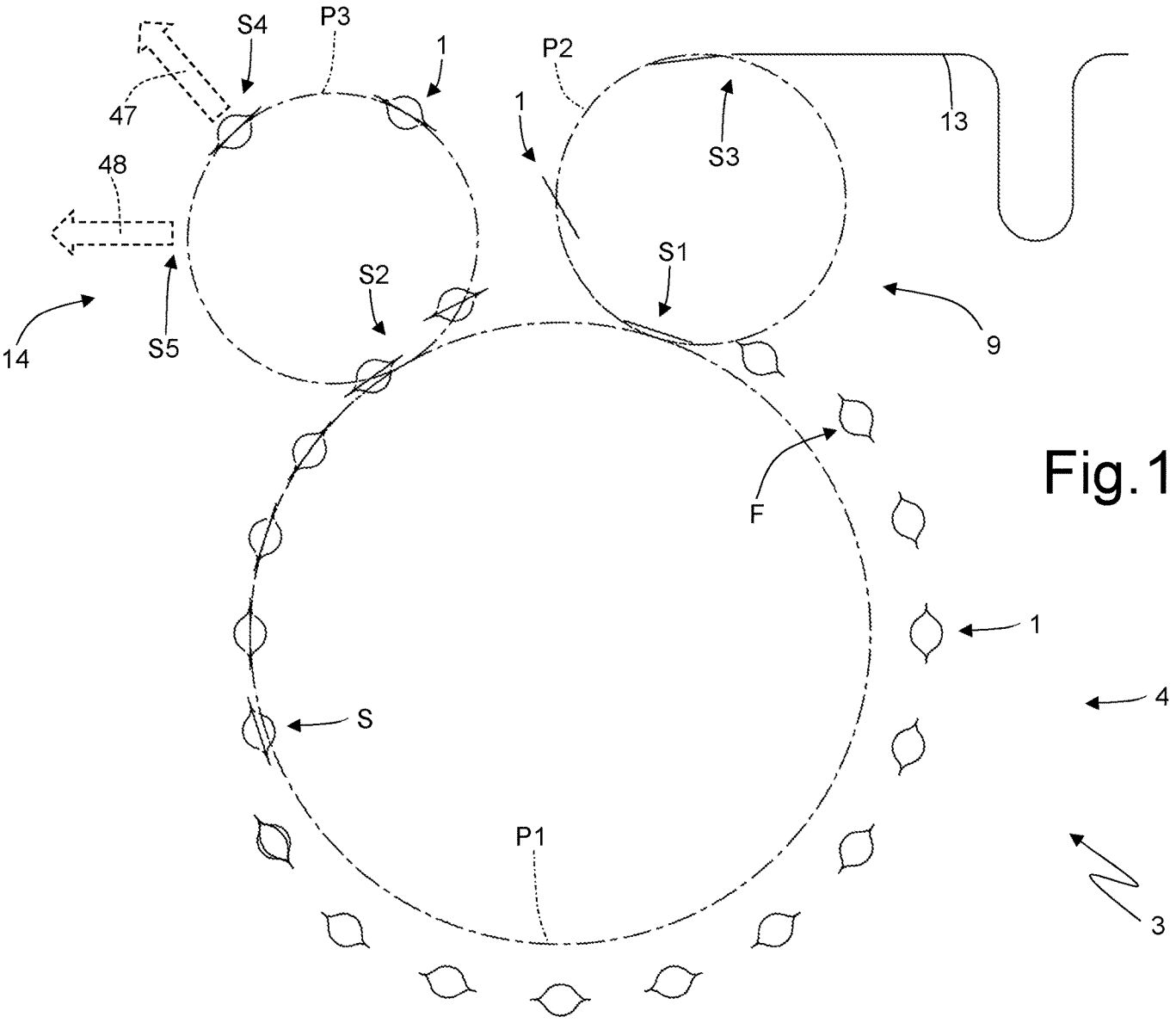
FIG. 14 is a schematic and plan view of a variant of the packaging machine of FIG. 2.

In the embodiment shown in FIGS. 1-13, the stabilizing conveyor 14 (or cooling conveyor 14) of the packaging machine 3 comprises a single transfer station S4 (shown in FIG. 4) from which each full, sealed bag 1 leaves the stabilizing head 17 and continues towards an exit of the packaging machine 3. In the alternative embodiment shown in FIG. 14, the stabilizing conveyor 14 (or cooling conveyor 14) of the packaging machine 3 comprises two transfer stations S4 and S5, from which each full, sealed bag 1 leaves the stabilizing head 17 and continues towards an exit of the packaging machine 3. In particular, the transfer station S5 is arranged downstream of the transfer station S4 along the stabilizing path P3 (that is, following the stabilizing path P3, each stabilizing head 17 passes first through the transfer station S4 and subsequently the transfer station S5).

The packaging machine 3 comprises an output passage 47, which receives the full, sealed bags 1 in the transfer station S4 and feeds the full, sealed bags 1 to a first packaging line (which is outside the packaging machine 3 and in which groups of full, sealed bags 1 are introduced into respective boxes). Furthermore, the packaging machine 3 comprises an output passage 48, which is separated and independent from the output passage 47, receives the full, sealed bags 1 in the transfer station S5 and feeds the full, sealed bags 1 to a second packaging line (which is outside the packaging machine 3 and in which groups of full, sealed bags 1 are introduced into respective boxes).

Each stabilizing head 17 of the stabilizing conveyor 14 receives a full, sealed bag 1 in the output station S2 from a pick-up head 7 of the packaging conveyor 4, makes the full, sealed bag 1 advance along the stabilizing path P3 and finally provides irrelevantly the full, sealed bag 1 either to the output passage 47 of the transfer station S4 or to the output passage 48 of the second transfer station S5. In other words, each stabilizing head 17 of the stabilizing conveyor 14 is designed to provide the full, sealed bag 1 to the output passage 47 in the transfer station S4 or to the output passage 48 in the second transfer station S5.

During normal operation, i.e., when both output passages 47 and 48 are operative (i.e., can receive the full, sealed bags 1 when the corresponding packaging machines are in operation), the stabilizing heads 17 of the stabilizing conveyor 14 alternately provides the full, sealed bags 1 to both output passages 47 and 48 in the corresponding transfer stations S4 and S5 (so one full, sealed bag 1 is transferred to the output passage 47 in the transfer station S4 and the successive full, sealed bag 1 is transferred to the output passage 48 in the transfer station S5, and so on).

When one of the two output passages 47 and 48 is not operative (i.e., when one of the two output passages 47 and 48 cannot receive the full bags 1 because the corresponding packaging machine is at a standstill, for example due to a machine flooding, maintenance intervention, a fault . . . ) all the full, sealed bags 1 are transferred from the stabilizing heads 17 of the stabilizing conveyor 14 only to the operative output passage 47 or 48 (that is, the non-operating output passage 47 or 48 is "ignored"). In this condition, generally, it is necessary to slow down the packaging machine 3 because a single output passage 47 or 48 cannot receive alone the entire nominal production of the packaging machine 3. However, while working at a reduced speed, the packaging machine 3 does not stop, thus keeping, as far as possible, the long-term productivity.

The presence of two output passages 47 and 48, in addition to allow not stopping the packaging machine 3 when an output passage 47 or 48 is temporarily not able to receive the full bags 1, also allows to differentiate the production of bags 1 (for example by varying the consistency of the dose of the loose product that is fed in the bags 1 and/or changing the conformation of the bags 1). Alternately, a bag 1 of a first type and a bag 1 of a second type are formed, all the bags 1 of the first type being directed to the output passage 47, and all the bags 1 of the second type being directed to the output passage 48. A bag 1 of the first type can be differentiated from a bag 1 of the second type, for example, by the consistency of the dose of the loose product and/or by the form (shape, size, and/or external prints) of the bag 1. In other words, two types of bags 1 differentiated between them are fed to the input station S1 and the pick-up heads 7, with all the bags 1 of the first type being transferred to the output passage 47 in the transfer station S4, and all the bags 1 of the second type being transferred to the output passage 48 in the transfer station S5.

The packaging machine 3 described above presents several advantages.

Firstly, the packaging machine 3 described above can improve the overall quality of the bags 1 thanks to a reduction in external contamination. This result is obtained thanks to the fact that the heat-sealing of the open upper end 2 of each bag 1 occurs immediately after the filling of the bag 1 itself (for each pick-up head 7, the sealing device 19 is arranged very close to the filling device 18: the mutual distance is of a maximum of 15-25 cm) and, therefore, the time for which the bag 1 remains full and open is extremely reduced (in this time period the inert gas contained in the bag 1 can partially flow out and be replaced by other not controlled gases present in the atmosphere). In this way, it is also possible to significantly reduce the consumption of inert gas, as it is not necessary to overdose the inert gas to compensate for high losses of inert gas between the filling and the heat-sealing. Moreover, all parts subject to high wear (seals and other rubber parts or similar) are far from the pick-up heads 7 (i.e. from the bags 1 and from the product dosed into the bags 1) eliminating the risk of possible contamination of the product and/or the bags 1 with rubber particles or similar.

The packaging machine 3 described above can improve the overall quality of the bags 1 also thanks to a better precision in the execution of the processing. This result is obtained thanks to the fact that in every moment of the processing the position of each bag 1 is ensured in an extremely precise and reliable way.

The packaging machine 3 described above can reduce the percentage of waste (i.e. of defective bags 1). This result is obtained thanks to the fact that, during the whole processing, the position of the bags 1 is always ensured in a very precise way also thanks to the use of a packaging conveyor 4 provided with a single drum 5 mounted rotating that directly supports the pick-up heads 7 (compared to a chain conveyor which is wound around guide pulleys, the control of the position of the pick-up heads 7 is improved).

The packaging machine 3 described above can reduce the space taken up and improve the accessibility for the execution of cleaning, maintenance and size change services (i.e. all the parts of the packaging machine 3 described above are easily accessible by an operator). These results are obtained thanks to the fact that the use of a packaging conveyor 4 provided with a single drum 5 rotary mounted that directly supports the pick-up heads 7 allows to considerably reduce the overall size of the packaging machine 3.

The packaging machine 3 described above requires reduced maintenance. This result is obtained thanks to the fact of using a packaging conveyor 4 provided with a single drum 5 entirely rotary mounted without any chain (the chains which continuously deform have a high level of wear that requires frequent maintenance).

Finally, the packaging machine 3 described above is of relatively simple and economical fabrication.

The invention claimed is:

1. An automatic packaging machine for filling a bag made of a heat-sealable material and having an open upper end configured to receive a dose of a loose product; the packaging machine comprising:

a packaging conveyor;

a pick-up head, which is supported by the packaging conveyor so as to be fed along a packaging path lying on a horizontal plane, that is designed to grab and hold the bag along the packaging path, and comprises a pair of first clamps, which are opposite one another and are designed to grab opposite side ends of the corresponding bag;

an input station, which is arranged at a beginning of the packaging path and where the bag, which is empty at the beginning of the packaging path, is grabbed by the pick-up head;

an output station, which is arranged at an end of the packaging path and where the bag, after being filled and sealed, leaves the pick-up head;

a filling device, which is movable along the packaging path and is designed to feed the product dose into the bag through the open upper end; and a sealing device, which is movable along the packaging path and is designed to seal the filled bag through a sealing at an area of the open upper end;

wherein:

the filling device and the sealing device are both mounted on the packaging conveyor so as to move together with the pick-up head along the entire packaging path;

the filling device and the sealing device are arranged on the packaging conveyor next to one another along a horizontal selection direction, which is transverse to the packaging path; and the pick-up head is movable on the packaging conveyor so as to move, along the selection direction, between a filling position, in which the pick-up head is aligned with the filling device, and a sealing position, in which the pick-up head is aligned with the sealing device.

2. The packaging machine according to claim 1, wherein:

the packaging conveyor comprises a first drum, which is mounted so as to rotate around a first rotation axis and supports the pick-up head, the filling device and the sealing device;

the packaging path has a circular shape; and the selection direction is oriented radially to the first rotation axis.

3. The packaging machine according to claim 1, comprising an opening device, which is arranged in the input station, configured to open the bag by moving apart the opposite side ends of the bag, comprising at least one first suction cup configured to engage a first surface of the bag, and is movable along the selection direction.

4. The packaging machine according to claim 3, wherein the pair of first clamps of the pick-up head are movable so as to be moved closer to and away from one another, thus following deformation of the bag when the bag is opened.

5. The packaging machine according to claim 3, wherein the first suction cup of the opening device is supported by the packaging conveyor and is movable on the packaging conveyor so as to move along the selection direction independently of the pick-up head.

6. The packaging machine according to claim 3, and comprising:

a supplying conveyor; and a supplying head, which is supported by the supplying conveyor so as to advance along a supplying path ending in an area of the input station, where the bag is transferred from the supplying head of the supplying conveyor to the pick-up head of the packaging conveyor, that is designed to receive and hold the bag along the supplying path, and comprises at least one second suction cup, which engages a second surface of the bag opposite the first surface.

7. The packaging machine according to claim 6, wherein:

the supplying conveyor comprises a second drum, which is mounted so as to rotate around a second rotation axis and supports the supplying head; and the supplying path has a circular shape.

8. The packaging machine according to claim 7, wherein the supplying head is rotatably mounted on the second drum so as to rotate relative to the second drum around a third rotation axis, which is parallel to the second rotation axis.

9. The packaging machine according to claim 1 and comprising:

a stabilizing conveyor; and a stabilizing head, which is supported by the stabilizing conveyor so as to advance along a stabilizing path beginning in an area of the output station, where the bag is transferred from the pick-up head of the packaging conveyor to the stabilizing head of the stabilizing conveyor, and is designed to receive and hold the bag along the stabilizing path.

10. The packaging machine according to claim 9, wherein:

the stabilizing conveyor comprises a third drum, which is mounted so as to rotate around a fourth rotation axis and supports the stabilizing head;

the stabilizing path has a circular shape; and the stabilizing head is rotatably mounted on the third drum so as to rotate relative to the third drum around a fifth rotation axis, which is parallel to the fourth rotation axis.

11. The packaging machine according to claim 9, wherein the stabilizing head comprises a second clamp, which is oriented perpendicularly to the first clamps of the pick-up head and is designed to grab an upper end of the bag in an area of the open upper end.

12. The packaging machine according to claim 1, wherein the filling device is movable on the first drum so as to move between a rest position and an operating position along a vertical operating direction, which is perpendicular to the selection direction and to the packaging path.

13. The packaging machine according to claim 1, comprising a waste chute, which is arranged in an area of the output station under the packaging conveyor and is designed to receive and convey, due to gravity, a defective bag that, in the output station, is released by the pick-up head.

14. The packaging machine according to claim 1, wherein:

a microwave control device is provided, which is mounted on the filling device or on the sealing device and is designed to detect the presence of a product in an area of the open upper end of the bag where the sealing is to be carried out; and the bag is identified as defective if the microwave control device detects the presence of a product in the area of the open upper end of the bag where the sealing is to be carried out.

15. The automatic packaging machine accordingly to claim 1, further comprising:

more than one of said pick-up head, each of which is supported by the packaging conveyor so as to advance along a packaging path lying in a horizontal plane and designed to grab and hold the bag along the packaging path;

more than one of said filling device, each of which is movable along the packaging path, is an operative member associated with a corresponding pick-up head, and is designed to feed a product dose into the corresponding bag through the open upper end;

a first output passage which receives full, sealed bags in a first transfer station;

a second output passage, which is separated and independent from the first output passage and receives the full, sealed bags in a second transfer station arranged downstream of the first transfer station.

16. The packaging machine according to claim 15 comprising:

a stabilizing conveyor; and a plurality of stabilizing heads, each of which is supported by the stabilizing conveyor to advance along a stabilizing path, which begins at the output station in which the bag is transferred from the pick-up head of the packaging conveyor to the stabilizing head of the stabilizing conveyor, is designed to receive and retain the bag along the stabilizing path, and is designed to provide the bag to the first output passage in the first transfer station or to the second output passage in the second transfer station.

17. The packaging machine according to claim 15, wherein each full, sealed bag is transferable to the first output passage in the first transfer station or to the second output passage in the second transfer station in such a way that, in case of failure in the first output passage, all the bags are transferred to the second output passage and vice versa.

18. The packaging machine according to claim 15, wherein:

two types of bags, which are different from each other, are capable of being fed to the input station and the pick-up heads;

all the bags of a first type are transferred to the first output passage in the first transfer station; and all the bags of a second type are transferred to the second output passage in the second transfer station.

19. A method for controlling the automatic packaging machine of claim 1 for filling more than one of said bag, comprising:

providing the automatic packaging machine of claim 1, said automatic packaging machine further comprising:

more than one of said pickup head, each of which is supported by the packaging conveyor so as to advance along a packaging path lying in a horizontal plane and designed to grab and hold a corresponding one of said bags along the packaging path; and more than one of said filling device, each of which is movable along the packaging path, is an operative member associated with a corresponding pick-up head and is designed to feed a product dose into the corresponding bag through the open upper end; the method for controlling further comprising the steps of:

detecting a correct operation of each pick-up head and/or of at least one operative member associated therewith so as to identify a possible failing pick-up head; and using, for the filling of the bags and in the absence of failing pick-up heads, all the pick-up heads by always feeding the corresponding one of said bags to each pick-up head in the input station;

using, for the filling of the bags and in the presence of at least one failing pick-up head, only the pick-up heads functioning properly, by feeding the corresponding one of said bags to each pick-up head properly functioning in the input station, avoiding the feeding of the corresponding bag to the failing pick-up head in the input station, and avoiding the operation of at least the filling device associated with the failing pick-up head.

20. The method for controlling according to claim 19, comprising providing more than one of said sealing devices, each of which is mounted movable along the packaging path, is an operative member associated with a corresponding pick-up head, and is designed to seal the corresponding bag.

21. The method for controlling according to claim 19, wherein a plurality of feeder devices is provided, each of which is mounted movable along the packaging path, is an operative member associated with a corresponding pick-up head, and is designed to put a cap onto the corresponding bag.

22. The method for controlling according to claim 19, wherein, in the presence of at least one failing pick-up head, the operation of the operative members that are associated with the failing pick-up head is avoided.

23. A method for controlling an automatic packaging machine for filling bags of heat-sealable material and having respective upper open ends with corresponding doses of loose product;

the packaging machine comprising:

a packaging conveyor;

a plurality of pick-up heads, each of which is supported by the packaging conveyor so as to advance along a packaging path lying in a horizontal plane and is designed to grab and hold a corresponding one of the bags along the packaging path;

an input station, which is arranged at a beginning of the packaging path and where each of the bags, which is empty at the beginning of the packaging path, is grabbed by a corresponding one of the pick-up heads;

an output station, which is arranged at an end of the packaging path and where each of the bags after having been filled and sealed leaves the corresponding pick-up head;

a plurality of filling devices, each of which is movable along the packaging path, is an operative member associated with a corresponding one of the pick-up heads, and is designed to feed a product dose into the corresponding bag through the open upper end;

at least one sealing device, which is designed to seal each filled bag through a sealing at an area of the open upper end;

a first output passage which receives the filled, sealed bags in a first transfer station; and a second output passage, which is separated and independent from the first output passage and receives the the filled, sealed bags in a second transfer station arranged downstream of the first transfer station;

wherein the method for controlling comprises a step of transferring each filled, sealed bag to the first output passage in the first transfer station or to the second output passage in the second transfer station.

* * * * *